US005082062A

United States Patent [19]

Wood et al.

[11] Patent Number: 5,082,062

[45] Date of Patent: Jan. 21, 1992

[54] HORIZONTAL INFLATABLE TOOL

[75] Inventors: Edward T. Wood, Kingwood, Tex.; David H. Surgnier, Golden, Colo.; Robert T. Brooks, Aberdeen, Scotland

[73] Assignee: CTC Corporation, Houston, Tex.

[21] Appl. No.: 586,248

[22] Filed: Sep. 21, 1990

[51] Int. Cl.[5] ..... E21B 23/02

[52] U.S. Cl. ..... 166/382; 166/214; 166/237

[58] Field of Search ..... 166/206, 212, 214, 136, 166/237, 382

[56] References Cited

U.S. PATENT DOCUMENTS

| | | | |
|---|---|---|---|
| 2,920,704 | 1/1960 | Fredd | 166/206 |
| 3,027,947 | 3/1962 | Fredd | 166/214 |
| 3,166,128 | 1/1965 | Myers | 166/214 |
| 3,856,081 | 12/1974 | Canalizo | 166/136 |
| 3,999,604 | 12/1976 | Amancharla et al. | 166/206 |
| 4,254,829 | 3/1981 | Watkins | 166/214 |

*Primary Examiner*—Bruce M. Kisliuk
*Attorney, Agent, or Firm*—Donald H. Fidler

[57] ABSTRACT

A well tool having an anchor device, straddle packers above and below a port and an internal valve which are operated by longitudinal motion in an inflatable packer device. The well tool anchor is armed by a hydraulic operated plug and set upon downward motion in a locating profile groove in a well bore. The tool when attached to a string of tubing can be filled with cement slurry and downward motion used to anchor the well tool in a profile groove in an inflatable packer; to set the straddle packers above and below an access port on an inflatable packer; and then to open a valve to admit cement slurry to the inflatable packer. After filling the inflatable packer with cement slurry, an upward motion is used to close the valve, unset the straddle packers and release the anchor to move to another location where the operation can be repeated. At the conclusion operations, a circulation valve is opened by pressure to reverse out cement slurry from the tubing string.

12 Claims, 7 Drawing Sheets

HORIZONTAL INFLATABLE TOOL

FIELD OF THE INVENTION

This invention relates to a system for selectively isolating a lengthwise extending segment of a tubular member disposed in a well bore and for selectively operating a valve between a string of tubing and the isolated segment for transferring liquid between the isolated segment in the tubular member and the string of tubing. The system utilizes a well tool on which a string of tubing can be selectively anchored with respect to a tubular member and which can selectively open a valve in the well tool solely by longitudinal motion of a string of tubing. More particularly the invention has a specific application to systems for selectively injecting liquid cement slurry in a string of tubing into an inflatable packer device in a horizontal or non-vertical well bore for inflating the packer device.

BACKGROUND OF THE INVENTION

Horizontal drilling of well bores is a relatively new technology where an initial segment of a well bore extends in a generally vertical direction and then is angled in a direction which can be normal to a vertical or with other angular relationships with respect to the initial vertical segment of the well bore. Where a horizontal or non-vertical section of the well bore traverses earth formations which contain hydrocarbons it is desirable to isolate selected formations from one another along a segment of the well bore from other sections along the well bore.

The present invention provides a practical system for obtaining a cement type sealing mechanism in the annulus between a well pipe and a well bore in horizontal or non-vertical sections of a well bore.

SUMMARY OF THE INVENTION

The present invention is particularly useful in a system where a string of pipe is disposed in a well bore which includes horizontal and angularly deviated sections and where the string of pipe carries spaced apart inflatable packer devices in the angularly deviated sections. Inflatable packer devices are well known and are of the type which can be inflated by the injection of cement slurry under pressure through an access port in the packer device. The cement slurry under pressure fills and inflates an inflatable packer element with cement along the elongated packer element typically about 20 to 40 feet in length. After the cement hardens within the packing element on the inflatable packer, the well bore is isolated by the hardened cement and the packer element of the packer device.

The present system contemplates use of a well tool at the end of a string of tubing which can be inserted through an existing well pipe in the well bore and located in an inflatable packer device. The well tool has expandable packer elements above and below a normally closed valve opening when the packer elements are positioned to straddle a cement access port in the inflatable packer device. The packer elements are expanded by a longitudinal motion of the string of tubing and the valve opening is opened by longitudinal motion of the string of tubing so that cement can be pumped through the string of tubing and into the inflatable packer device to inflate the packer element on the inflatable packer. Following inflation of the packer device, the valve opening in the well tool is closed and the well tool packer elements retracted by an opposite longitudinal motion so that the string of pipe containing cement can be moved to a second inflatable packer device where the operation can be repeated to selectively inflate a second inflatable packer device.

When all of the inflatable packer devices in the string of pipe are inflated as described above, a circulation valve in the string of tubing is opened so that cement in the string of tubing can be reversed out to the earth's surface.

During this entire operation of inflating the inflatable packer devices, cement contained within the string of tubing is used to selectively inflate one or more packer elements of inflatable packer devices located in a string of pipe in a well bore.

In respect to structure, the well tool has locating means which are arranged to locate the well tool in an inflatable packer device disposed in a well bore so as to position a valve port or opening on the well tool adjacent to the access port of the inflatable packer device. After the well tool is located in a packer device, latching means are utilized to hold the well tool in a fixed position in the well tool. The latching means are dog elements which are held in a normally retracted position in the well tool while going in and are conditioned for operation after being located in a packer device by hydraulic pressure in the string of tubing.

When the well tool is in an inflatable packer device, a dart or plug is pumped down the string of tubing and seats in the well tool. Applied pressure in the string of tubing then enables a locking collar on the well tool to be shifted longitudinally to release the latching dog elements. The latching dog elements when released from the latching collar are spring biased outwardly into contact with the inner surface of the well pipe or packer device. Upon a downward shifting of the well tool, the projecting dog elements latch into an annular recess in the well pipe or inflatable packer device. The actuation of the latching dog elements does not operate the valve in the well tool. When the well tool is located with the latching dogs in position in the latching recess the latching dogs prevent a lower expander collar on the well tool from moving downward in a well pipe so that a downward stroke on the string of tubing moves a central actuating member in the well tool relative to the lower expander collar. The central actuating member is releasably coupled to an upper slidable expander collar on the well tool by a transfer dog latch means and compresses a pair of spaced apart expandable packer elements located adjacent to an intermediate expander collar to distort into sealing engagement with the wall of the well pipe at locations above and below a valve opening or port in the intermediate expander collar. Continued downward stroke of the string of tubing activates the transfer dog latch to lock the upper expander collar to the lower expander collar through an underlying packer support mandrel which extends along the interior of the expander collars. Thus the packer elements are locked in an expanded condition and in compressing the packer elements, the valve port or opening is aligned with a support mandrel valve opening located in the support mandrel.

After locking the packer elements in a set condition, further downward movement of the central actuating member interlocks with slidable valve sleeve which then moves with the central actuating member. The slidable valve sleeve has a valve sleeve port which is aligned with an actuating member port. The downward motion of the central actuating member after the packer elements are locked in a set condition then aligns the support member port and the valve port with the other ports. This places the port in the central actuating member in fluid communication with all of the aligned openings or ports so that fluid communication is accomplished between the bore of the central actuating member and the valve port in the intermediate collar member.

Cement slurry is pumped down the string of pipe behind a cement dart and the dart locks in the central actuating member at a location below the access port in the central actuating member. The cement slurry can then fill the inflatable packer element. When the inflatable packer device is fully inflated, the tool operation is reversed. That is, picking up on the string of tubing closes the valve opening in the intermediate expander member and moves the valve sleeve back to a locked condition with the packer support mandrel and releases the packer support mandrel from its locked position. Further upward travel deactivates the packer elements and locks the packer support mandrel to the central actuating member. Still further upward movement releases the dog elements from the latching groove.

The released tool together with a cement slurry in the string of tubing is raised to the next above inflatable packer where the inflation process is repeated. This operation can be repeated for as many inflatable well packers as required. Upon completion of the operation, the tool is located in a blank section of casing and pressure can be introduced into the well bore annulus to open a circulation valve so that cement can be reversed out of the string of tubing prior to retrieving the well tool.

DESCRIPTION OF THE INVENTION

Figure 1:
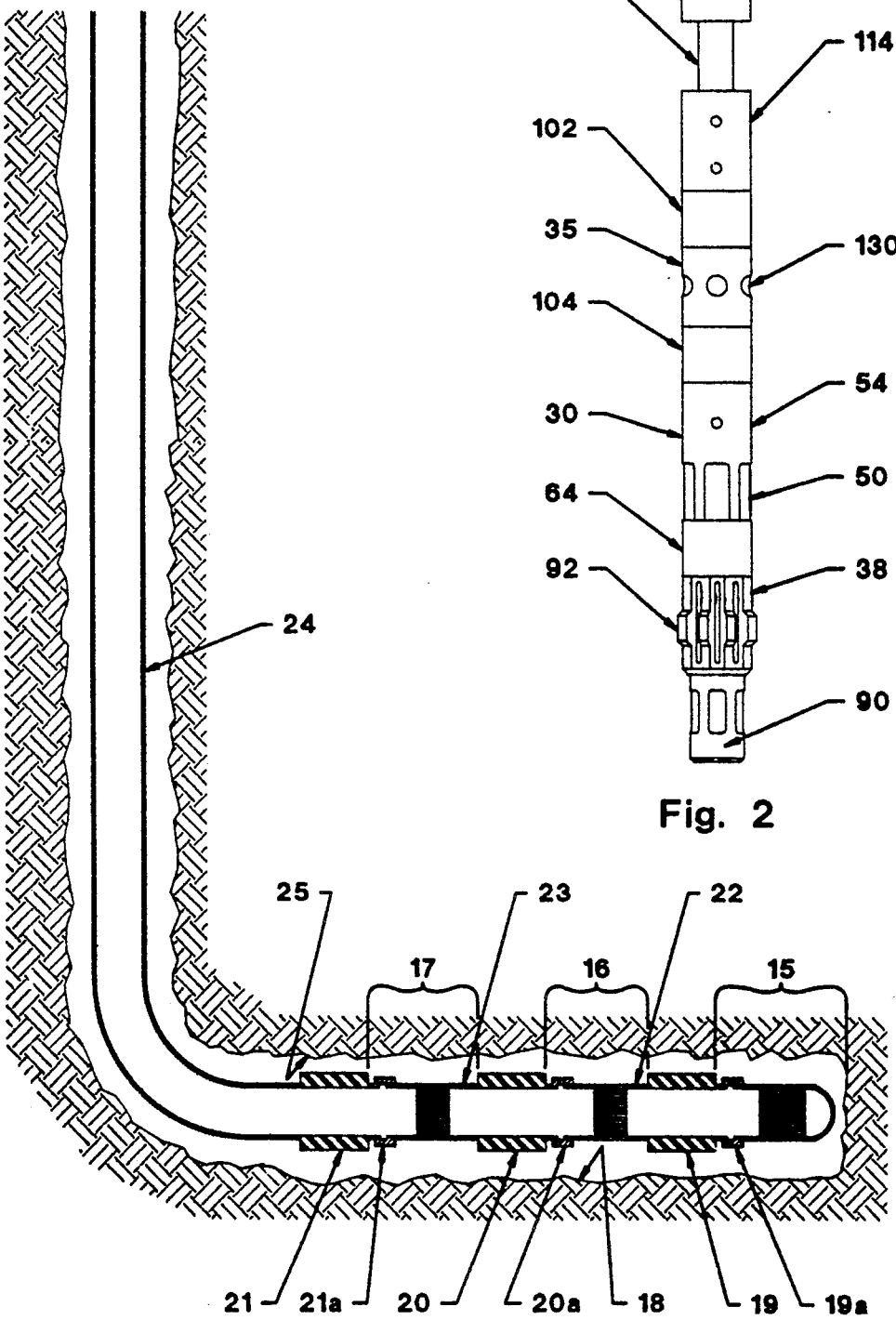
FIG. 1 is a schematic representation of an application of the present invention in a well bore environment.

Referring to FIG. 1, in completing well zones such as the zones 15,16 and 17 indicated in the drawings where there is a horizontal section or non-vertical section 18 of well bore, spaced apart inflatable packers 19,20 and 21 are connected to one another by an interconnecting pipe members 22 and 23 and are connected by a string of pipe or casing 24 to the surface of the ground. The section of pipe 22 and 23 located between the inflatable packers 19 and 20 and between packers 20 and 21 can be pre-slotted or can be perforated before the inflatable packers are expanded.

The inflatable packers can be, for example, of the type illustrated in U.S. Pat. No. 4,402,517 where an elongated elastomer packer element is disposed about a central metal tubular member. The valving for the inflation of the packer element is preferably at an upper end of the tool and serves to control the admission of cement and inflation of the packer element. In the present invention a knock out cap is not required and the opening to the valve is at the inner wall of the central member. When a liquid cement slurry is introduced into the annular space between the inflatable packer element and the central tubular member, the packer element is inflated into sealing engagement with the wall of the well bore 25 thereby providing fluid tight seal of the wall of the well bore with respect to the central tubular member of the inflatable packer. It can be appreciated that where the inflatable packers are spaced from one another, the zone intermediate of adjacent inflatable packers can be produced through perforations in the connecting pipe 24 to the ground surface.

Figure 2:
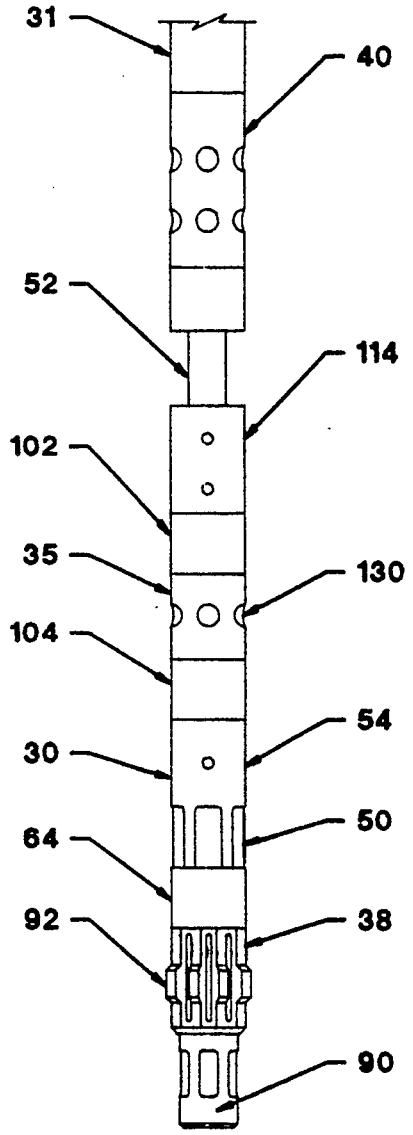
FIG. 2 is an outline illustration of an assembled well tool according to the present invention.

As shown in FIG. 2, in one aspect of the present invention, a selectively operated well tool 30 can be insertable through the string of pipe 24 at the end of a string of tubing 31 to a location within the lowermost or the inflatable packer 19 which is the most remote from the end of the string of pipe at the earth's surface. Associated with each packer 19,20,21 is an anchor profile member 19*a*,20*a* and 21*a*. The selectively operable well tool 30 can be located and anchored with respect to an annular profile member 19*a* of an inflatable packer so that a pair of spaced apart packer elements 102,104 on the well tool 31 can be expanded to isolate a valve opening (not shown in FIG. 2) in the inflatable packer device. The well tool 30 is operated to place a valve opening 130 in the well tool into fluid communication with the isolated valve opening in the inflatable packer device so that liquid cement slurry can be pumped down the string of tubing 31 and moved through a selectively opened valve in the well tool 30 to the isolated valve opening located between the spaced apart sealing elements 102,104 on the selectively operated well tool. When the liquid cement slurry is passed through valve opening 130 between the packer elements 102,104 on the well tool 30 and enters into the access opening of an inflatable packer device, the packer element on the inflatable packer device is inflated. When the inflatable packer element is fully deployed or inflated and is in sealing operative condition in the well bore 25, the operator picks up or lifts the string of tubing 31 which first closes the valve in the well tool 30 and prevents liquid cement slurry in the string of tubing from escaping from the string of tubing. Further upward movement of the string of tubing then releases the packer elements 102,104 on the well tool 30 and then de-actuates or unanchors the well tool so that it can be raised or shifted to the next closest inflatable packer device.

When the well tool reaches the next inflatable packer device 20, the anchor 50 on the well tool 30 is again set by a downward motion of the tubing string so that the valve opening 35 is located proximate to the access opening of the inflatable packer device. After anchoring the well tool, the downward movement of the string of tubing selectively first sets and locks the spaced apart packing elements 102,104 on the well tool and then opens the valve in the well tool so that cement in the string of tubing 31 can be introduced through the valve to the access opening in the inflatable packer element and inflate the inflatable packer element to a sealing condition with respect to the well bore wall. After the inflatable packer element is fully extended, the string of tubing is again picked up and the valve in the well tool 30 is first closed followed by unsetting of the packing elements 102,104, followed by unanchoring of the well tool so that it is released from the inflatable packing element. As may be appreciated if there are more than two inflatable packer devices in the well bore this process can be sequentially repeated until all or the selected packer devices are inflated as desired.

In the foregoing system, the well tool 30 has locating means 38 which serve to locate the well tool relative to a profile member (19*a*, for example). The tool 30 has anchoring or latching means 50 shown in a retracted condition which are selectively movable outwardly of the well tool to engage a profile member. An upper expander collar 114 is selectively coupled to a central actuating member 52 which selectively sets the packing elements 102,104. The central actuating member 52 is coupled to a circulating valve 40 which, in turn is coupled to a string of tubing 31.

When the inflation of the inflatable packer devices is completed, the tool 30 is located in a blank section of casing and set and pressure is applied in the annulus between the string of pipe and the string of tubing to open the pressure operated circulating valve 40 in the string of tubing. When the circulating valve 40 is opened, the cement in the string of tubing can be pressured out through the tubing and returned to the earth's surface by pumping fluid through the annulus between the string of pipe and the string of tubing which is a well known process known as reverse circulation.

A selective operating valve 35 (dashed line, FIG. 2) within the well tool as well as the anchor means 50 in the embodiment illustrated are sequentially operated by the central tubular actuating member 52. Hydraulic pressure is utilized first to release the anchor means 50 relative to the central actuating member 52. Then, slacking off or a downward movement of the central actuating member 52 relative to the anchor means 50 sets the anchor in a profile member against downward movement, sets the expandable packer elements 102,104 on the well tool 30 and opens the valve 35 in the well tool. A reverse motion of the central actuating member 52 sequentially closes the valve 35, unsets the packer elements 102,104 and releases the anchor members from a profile member.

Figure 3A:
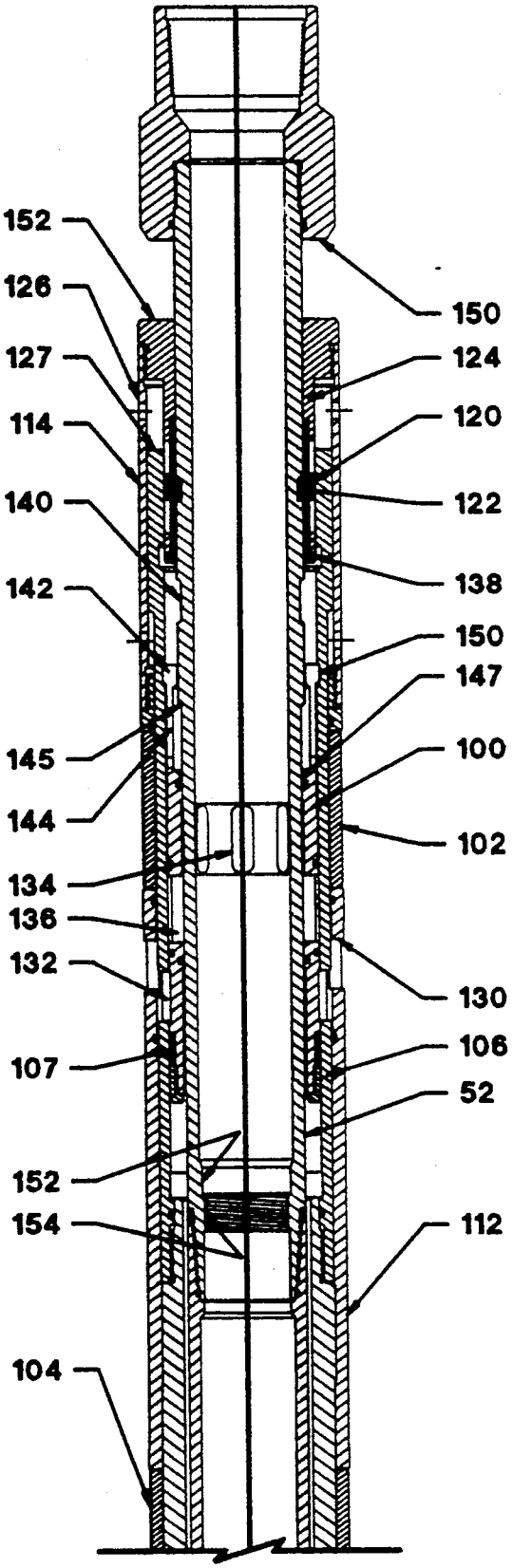
FIG. 3A and FIG. 3B are end to end views in longitudinal cross section of an embodiment of the well tool of the present invention.
Figure 3B:
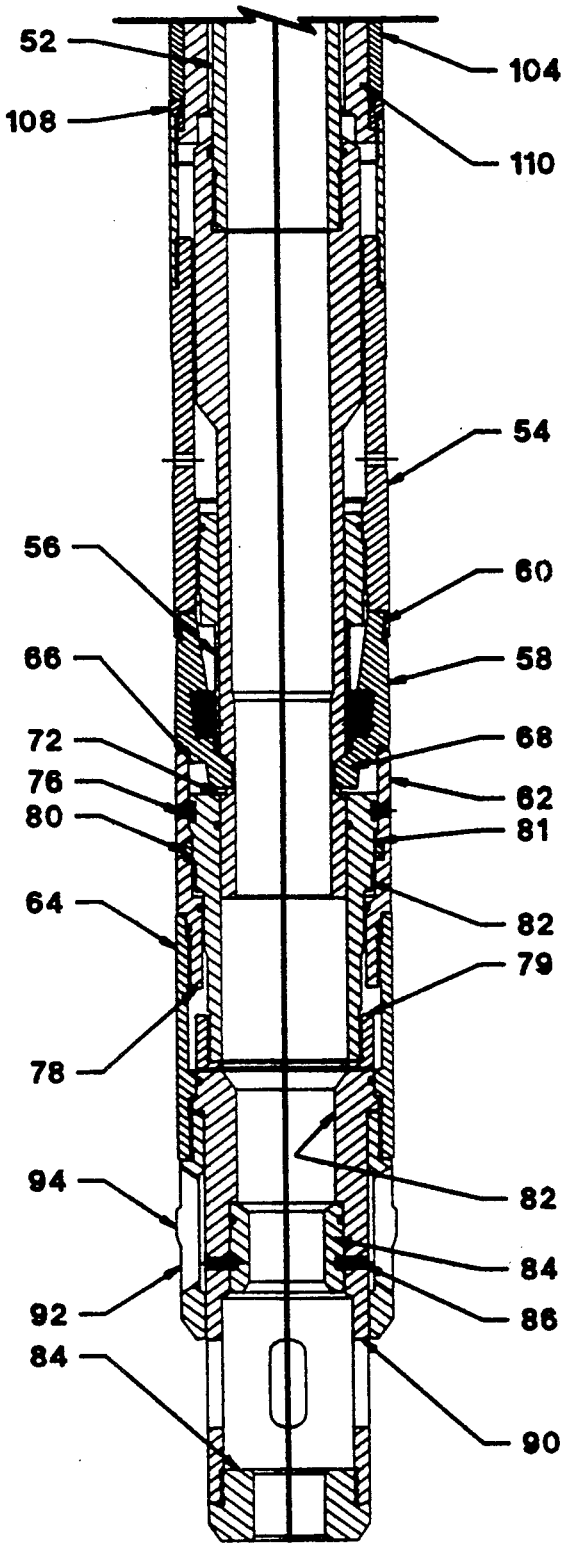
Figure 9:
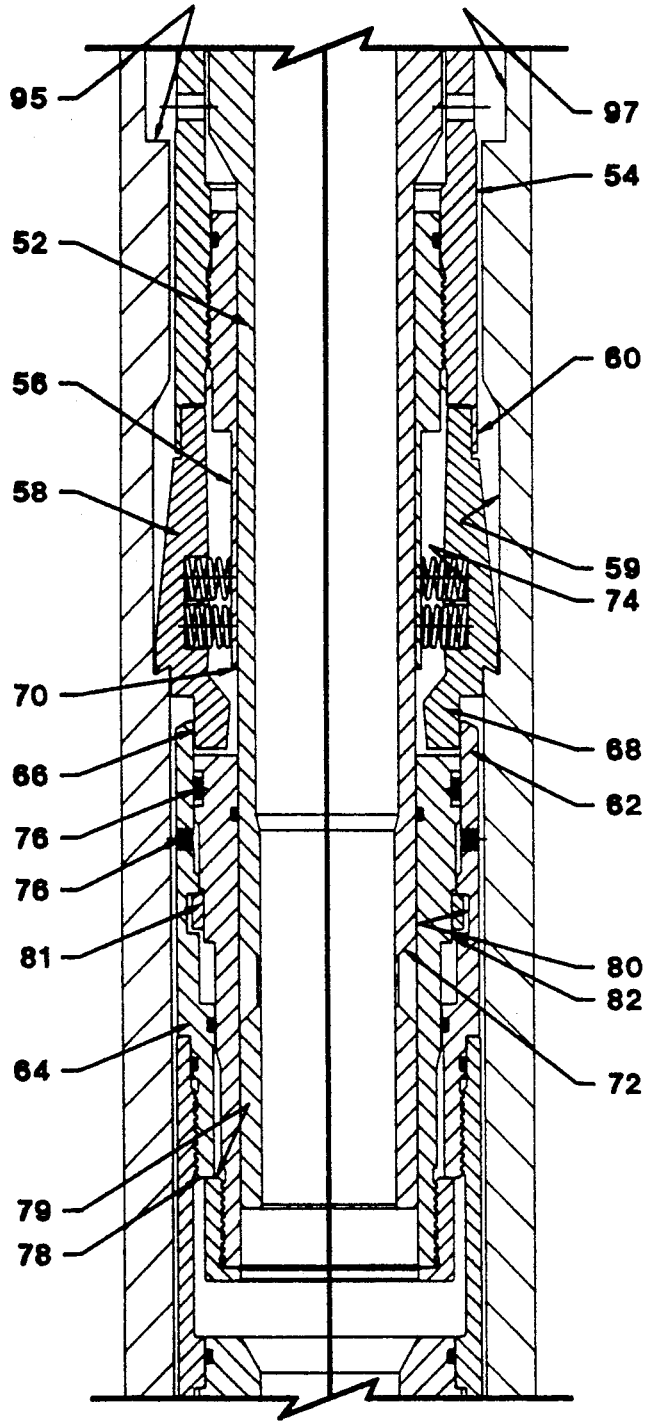
FIG. 9 is a view in partial longitudinal cross section showing the dog elements in an anchoring condition, and the tool in a set condition.
Figure 11:
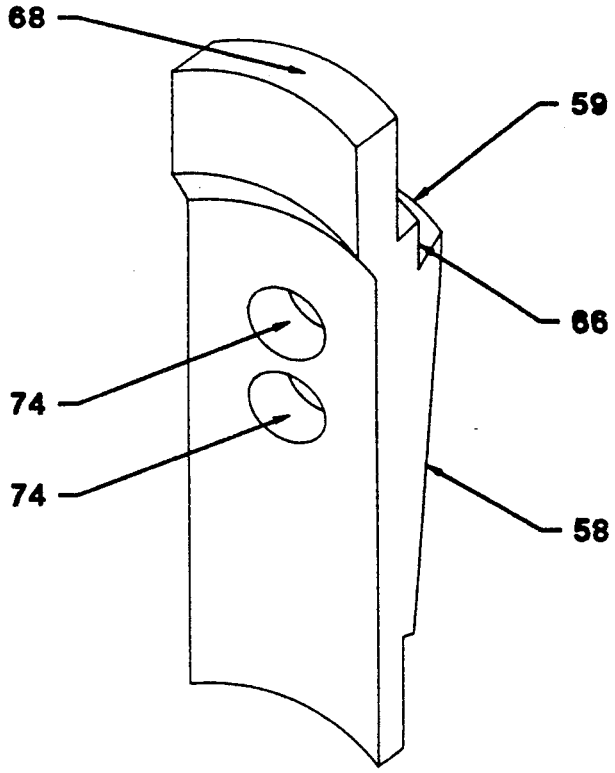
FIG. 11 is a perspective view of a dog element.

The anchor means 50 as shown in FIG. 3B and shown partially in FIG. 9 includes the tubular central actuating member 52 which is comprised of a number of interconnected parts which are not separately identified for clarification purposes. A tubular lower expander collar 54 is disposed about the terminal end of the central actuating member 52 and has circumferentially spaced elongated recesses 56 (see FIG. 9) which receive elongated dog elements 58. The lower expander collar 54 is comprised of a number of interconnected parts which are not separately identified for clarification purposes. The dog elements 58 (see FIG. 11) have a somewhat triangular configuration in longitudinal cross section with an outer curved surface 59 in transverse cross section which aligns within the outer cylindrical configuration of the well tool in an initial unactuated condition of a dog element. A dog element 58 is held in the initial retracted condition by an upper lip segment 60 which extends over the recess 56 in the lower expander collar 54 and by an annular wall 62 of a locking collar 64 which engages a lock recess or notch 66 in the outer surface of a dog element 58. The locking collar 54 is comprised of a number of interconnected parts which are not separately identified for clarification purposes. Ar the lower inner end of a dog element 58 is a tab 68 which extends through an opening 70 (see FIG. 9) in the wall of the lower expander collar 54 and is lodged in an annular recess 72 in the central actuating member 52. Each dog element 58 has an intermediate pair of recesses 74 which receive compressed spring members. Thus, in the position of a dog element 58 shown in FIG. 3B, the dog elements are confined within the cylindrical configuration of the well tool, the spring members are compressed, and the tabs 68 interlock the central actuating member 52 to the lower expander collar 54.

The locking collar 64 is releasably coupled to the lower expander collar 54 by a shear pin 76 in a first position (FIG. 3B). When the shear pin 76 is sheared, the locking collar 64 can slide downwardly on the lower expander collar 54 until facing surfaces 78,79 on the lower expander collar 54 and the locking collar 64 abut one another in a second position (FIG. 9). The locking collar 64 has an internal annular recess 80 which contains a snap ring 81 and the latching collar 54 has a longitudinally displaced external recess 82. When the facing surfaces 78,79 abut one another in the second position (FIG. 9), the snap ring 81 will latch into the external recess 82 to retain the locking collar 64 in the second position. In the second position, the annular wall 62 is displaced from the notch 66 in a dog element 58 and the dog element 58 can spring outwardly relative to the outer cylindrical configuration of the well tool so that the notch 66 in a dog element is displaced outward from the outer cylindrical configuration of the well tool. The arrangement is such that the tab 68 will not release the locking collar 54 from the central actuating member 52 until the dog element is in an annular latching groove 59 (FIG. 9). The length of the dog elements 50 is such that the elements are longer than pipe gaps at collars and will not be falsely anchored in a casing collar groove. When the dog element 58 is in a latching groove 59, the tab 68 is removed from the recess 72 in the central actuating member 52 so that the central actuating member 52 is released for movement relative to the lower expander collar 54.

At the lower end of the locking collar 64 is a bore section 82 which contains an annular plug seat 84 for receiving a closure plug member (not shown in FIG. 3B). A closure plug member 85 (see FIG. 5) may be pumped down the string of tubing so that it seats in the bore of the plug seat 84 so that hydraulic pressure can be applied to the locking collar 64 to shear the shear pin 76 which releasably connects the lower expander collar 54 to the locking collar 64. The plug seat 84, as illustrated in the drawings, is in an annularly shaped sleeve which is shear pinned by a shear pin 86 to the locking collar 64. If the pressure on the closure plug is increased to a value above the shear value for the shear pin 86, the shear pin 86 will release and the plug seat 84 will move downwardly in the locking collar 64 to a lower position in engagement with a catcher flange 88 on the locking collar 64. In this position of the plug seat, a bypass opening 90 in the locking collar 64 is open for communication between the interior of the bore section 82 and the exterior of the well tool.

On the lower exterior end of the locking collar 64 are circumferentially arranged, longitudinally extending finger members 92 which have outwardly extending detent portions 94 arranged around the circumference of the well tool. The finger members 92 are designed so that the detent portions 94 can engage an upwardly facing shoulder 95 (see FIG. 9) in an inflatable packer device or collar in the well pipe. The finger members 92 have a rectangular cross section and have limited radial flexibility so that the detent portions 94 can be moved into and out of the recess 97 which defines the shoulder 95 but only with a detectable force level on the string of pipe so that the operator can determine when the detent portions 94 engage shoulder above a latching groove 95. This provides a positive locating device for the system.

Figure 4:
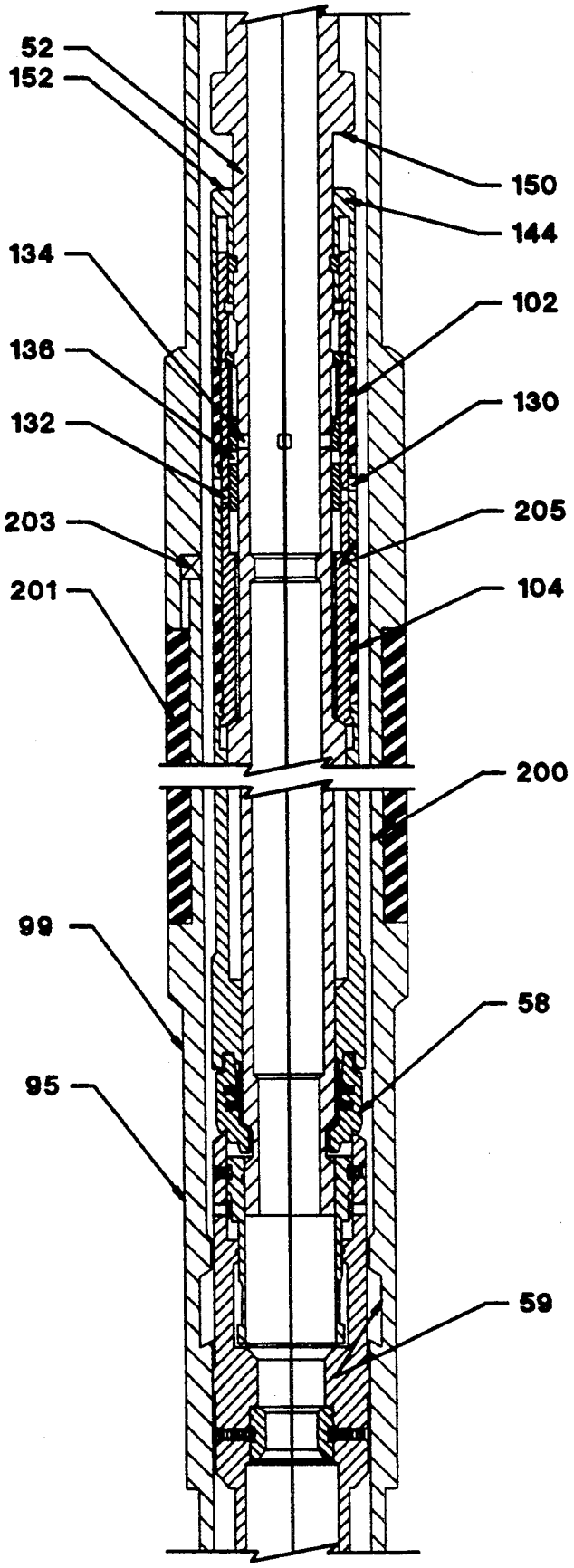
FIG. 4 is a view in longitudinal quarter section of the well tool of FIG. 3A,3B run into an inflatable well packer.

In operation, the well tool is lowered by the string of tubing to a location where the detent portions 94 positively locate the shoulder 95 and the adjacent annular latching notch 59 in a selected inflatable packer device 99 (see FIG. 4). This location is obtained by measurement of the length of the string of pipe or tubing in the well bore so that the detents portions 94 first pass the shoulder 95 and then pass the notch 59. Ar this time the detent portions 94 in the locking collar are below the latching groove 59 in the inflatable packer device 99 or collar and the dog elements 58 are located above the latching groove 59. The force on the string of tubing will increase to give the operator at the surface an observable indication that the detent portions 94 are just past the shoulder 95 and the latch groove 59 in the inflatable packer device 99 and thus insure the proper placement of the well tool.

The plug element 85 (see FIG. 5) is dropped into the string of pipe and pumped down under liquid under pressure to seat in the plug seat 84 and sufficient pressure is applied to shear the shear pin 76 and to move the locking collar 64 to a position where the dog elements 58 are disengaged and project outwardly into contact with the wall of the inflatable packer element and where the ring 81 in the recess 82 (FIG. 9) hold the locking collar 64 in the second position relative to the upper expander collar 54. The sizing of the outer circumference of the well tool relative to the bore of the packer device and the dog elements 58 is such that the tabs 68 retain the expander collar 54 and central actuating member 52 interlocked until the dog elements 58 are fully extended into a latching groove.

Figure 5:
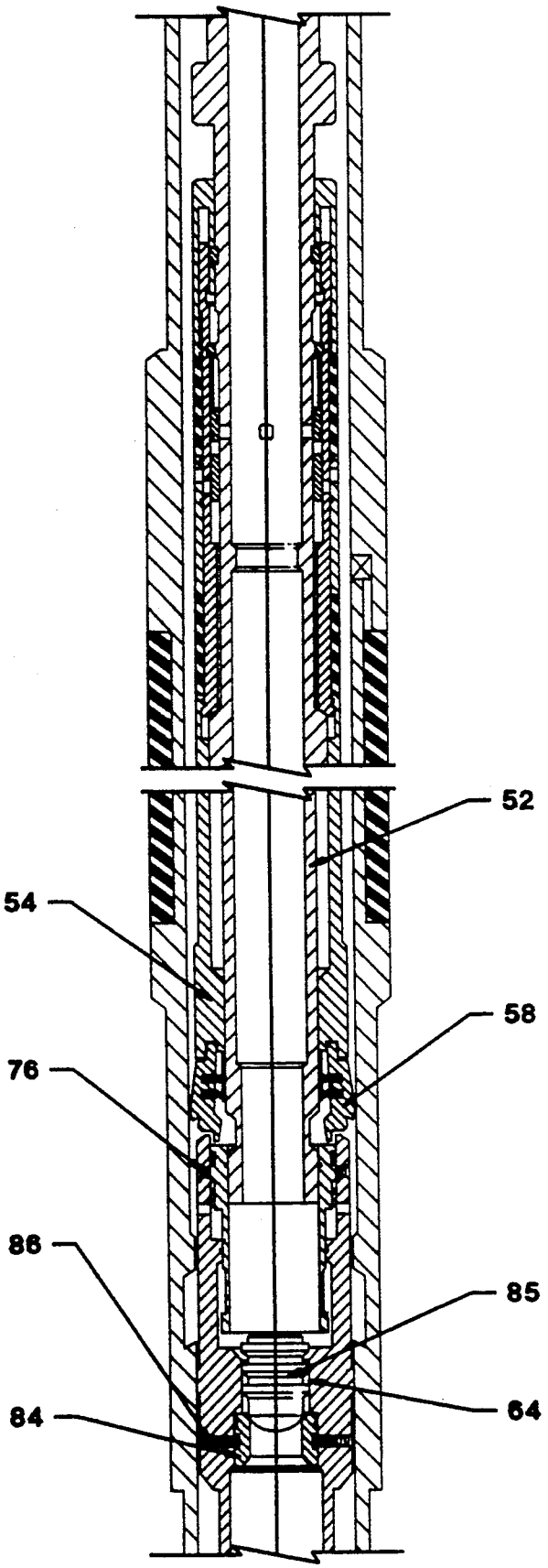
FIG. 5 is a view in longitudinal quarter section of the well tool of FIG. 3A,3B with the dog elements for anchoring shown in a released condition.

When the dog elements 58 are initially released, the detent portions are below the latching groove and thus the operator knows that when the string of pipe is lowered, the spring biased dog elements to engage with the latching groove in the inflatable packer element device 99. Before lowering the well tool and after the dog elements 58 are released, the pump pressure is increased to shear the pin 76 and move the plug 85 and seat 84 to the flange 84 (FIG. 3B) and open the ports 90. Next as shown in FIG. 5, a cementing plug 101 and cement slurry 103 can be introduced through the string of tubing to the closed valve in the well tool. Next, the string of tubing is lowered and the engagement of the notches 66 on the dog elements 58 with the latching groove is immediately apparent by the change in force on the string of tubing applied at the earth's surface (see FIG. 7). When the dog elements 58 are in the latching groove 59, the tab elements 68 are released from the central actuating member 52 and upon continued downward slacking off or applying force to the central actuating member 52, the packer elements 102,104 on the tool are expanded and the valve in the tool is actuated or opened.

Referring now to FIG. 3A, the valve in the well tool includes the central actuating member 52 and a valve sleeve 100 which operate in conjunction with straddle packer elements 102,104 and a tubular packer support member 106. The support member 106 is a tubular member disposed on the central actuating member 52 intermediately between the actuating member 52 and the upper expander collar 114. As illustrated in the drawings (FIG. 3B), the lower expander collar 54 has an internal shoulder 108 which engages a flange 110 on the packer support member 106 (at its lower end). Slidably mounted on the packer support member 106 is the internal shoulder 108 of the lower expander collar 54, the lower packer element 104, an intermediate expander collar 112, the upper packer element 102 and an upper expander collar 114.

Figure 12:
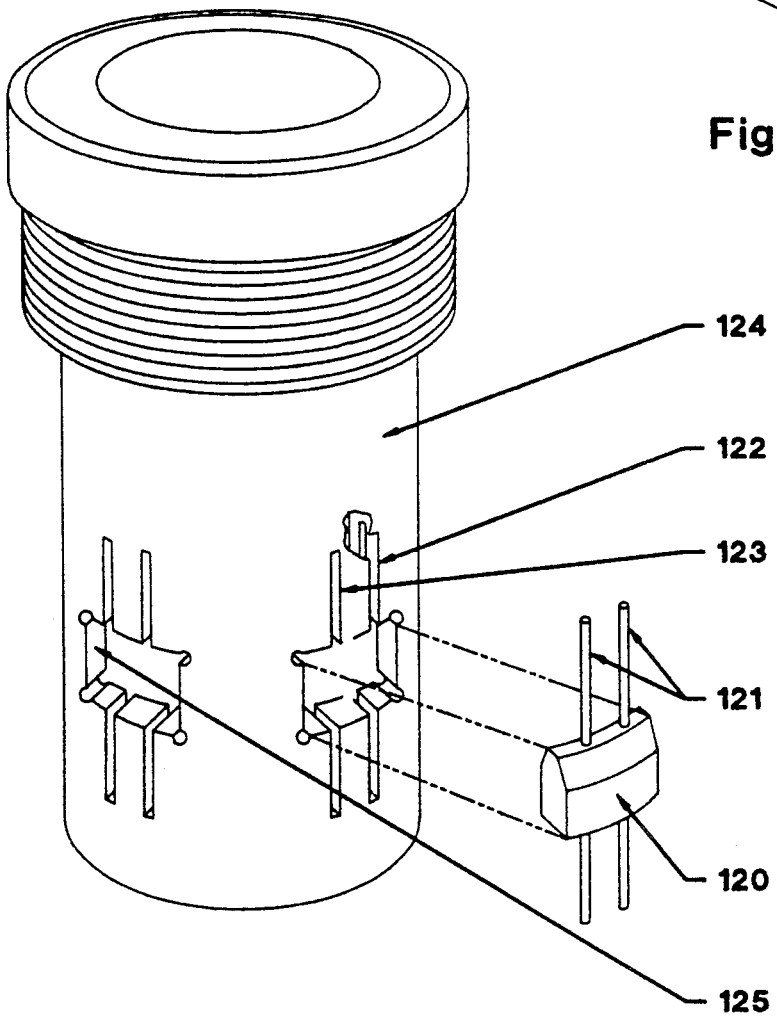
FIG. 12 is a perspective view of a portion of the upper locking collar.

The upper expander collar 114, which is an outer tubular member with respect to the central actuating member 52, is releasably coupled to the central actuating member 52 so that the central actuating member 52 can move the upper expander collar 114 downwardly to compress the upper and lower packer elements 102,104 on the packer support member 106. This is accomplished by a releasable interconnection between the upper expander collar 114 and the central actuating member 52 which consists of radially movable detent members 120 (see FIG. 12) which are supported by lengthwise extending spring members 121 disposed between lengthwise extending slots 122,123 in an inner tubular sleeve part 124. The sleeve part 124 is disposed in an annulus between the tubular packer support member 106 and the central actuating member 52. The inner tubular sleeve part 124 and the outer upper expander collar 114 define an annular recess. The detent members 120 are circumferentially disposed about the sleeve part 124 and received in detent recesses 125 in the sleeve part 124 (See FIG. 12).

The detent members 120 engage an annular recess 122 in the central actuating member 52 and are held in position in the recess 122 by the inner cylindrical surface of the packer support mandrel 106. As a consequence of the interconnection, downward movement of the central actuating member 52 moves the detent members 120 and the interconnected upper expander member 114 downwardly to a location where a valve port 130 in the expander collar 112 is in alignment with a support member port 132 in the packer support mandrel 106 and the locking detent members 120 are located adjacent to an annular detent recess 138 in the packer support member 106. Also, the lower face 126 of the upper expander collar 114 engages the upper face 127 of the packer support member 106.

At the location just described, the detent members 120 switch from the detent groove or recess 122 in the central actuating member 52 to the other detent groove or recess 138 in the packer support member 106 and effectively trap or lock the upper expander collar 114 to the packer support member 106 in a position where the upper and lower packer elements 102,104 on the packer support member 106 are compressed and in engagement with the inner wall of the inflatable packer device. (See FIG. 7). At this time actuating member ports 134 in the central actuating member 52 are in fluid communication with valve sleeve ports 136 in the valve sleeve 100.

At the same time that the packer elements 102,104 are being locked in a compressed condition within an inflatable packer device, an annular recess 140 in the central actuating member 52 is located next to locking detent members 142 on collar fingers 144 on the upper end of the valve sleeve 100. The locking detent members 142 are initially in a locking recess 150 in the packer supporting mandrel 106 and are released into the annular recess 140 on the central actuating member 52. A downwardly facing shoulder 145 on the central actuating member 52 engages an upwardly facing shoulder 147 on the valve sleeve 100 so that the valve sleeve 100 and the central actuating member 52 (and aligned ports 134,136) can be moved downwardly into alignment with the aligned valve port 130 and the support member port 132. Fluid may be communicated between the isolated area between the packer elements 102,104 and the interior of the string of tubing. If desired, the tubing string can be further lowered to cause a shoulder 150 on the well tool which is engaged with the upper end 152 of the upper expander collar 114 to exert an additional downward sealing pressure on the upper and lower packer elements 102,104 to maintain the sealing engagement with the interior wall of an inflatable packer device.

The cementing plug 101 is adapted to be seated in an internal bore section 152 in the central actuating member 52 and locked therein. The internal bore section 152 has latching grooves 154 for the plug 101. When the ports 134, 136,132,130 are aligned, cement can be pumped into the isolated space between the compressed packer elements 102,104 and into an access opening on the inflatable packer element 99. Because the annular space between the intermediate expander collar 112 and the wall of an inflatable packer device 99 is very small, little cement is displaced into the annulus between the outer housing and the inner wall of an inflatable packer.

When sufficient cement slurry has been injected into an inflatable packer device to inflate the packer element of the packer device, the operator raises the string of tubing which reverses the sequence of operations. When the central actuating member 52 is moved upwardly, the valve sleeve 100 is moved upwardly until the collet detents 142 reseat in the lower recess 150 on the central support member 52. This closes off the valve port 136. At the same time, the dog larches 120 transfer from the upper recess 138 on the packer support mandrel 106 to the recess 122 in the central actuating member 52. When the upper expander collar 114 is latched to the central actuating member 52, the packer elements 102,104 are decompressed as the setting force is removed. A shoulder 160 on the central actuating member 52 engages the lower end of the packer support member 106 and moves the support member 106 to the initial condition as shown in FIG. 3A.

In the foregoing description of this complex tool reference has not been made to 0-rings which are utilized for sealing purposes. 0-rings are interdispersed throughout the tool to provide sealing as necessary to accomplish the proper functioning of the tool similarly bypass or relief ports are shown but not described such ports being commonly used to prevent creation of undesirable pressure differentials in the well tool. However, of note is the packing element seal 107 on the valve sleeve 100 located below the support mandrel port 132 to assure that cement can not leak into the tool.

Figure 10:
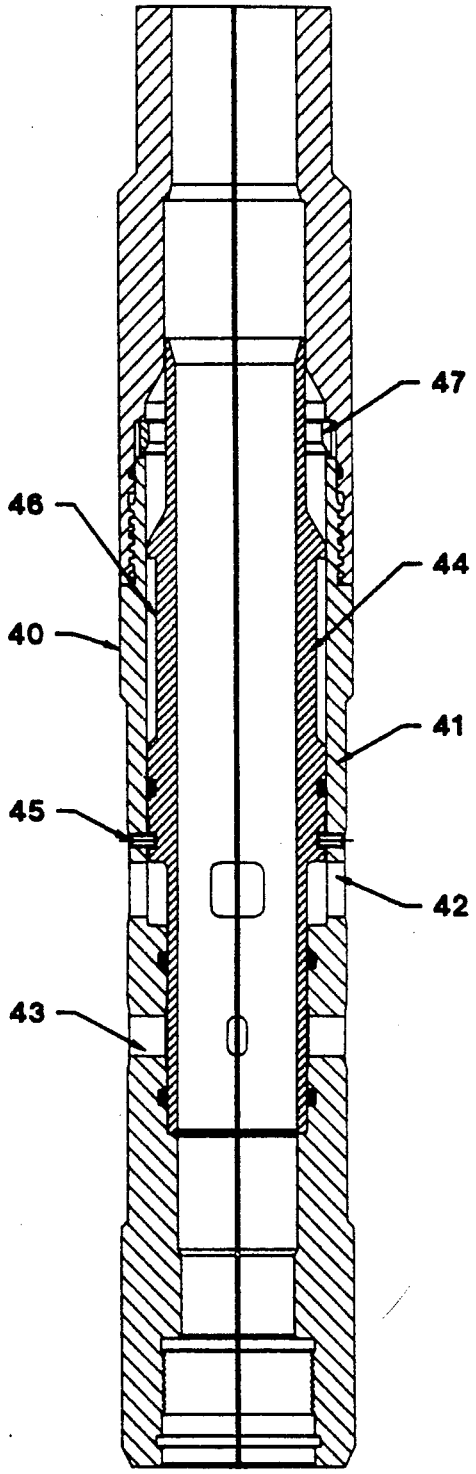
FIG. 10 is a view in longitudinal cross section of a circulating valve for use with the present invention.

Referring to FIG. 10, a circulation valve 40 is illustrated which interconnects between a string of tubing and the central actuating member 52. The circulation valve 40 includes an outer tubular housing 41 with longitudinally spaced pressure ports 42 and valve ports 43. A tubular valve sleeve 44 is shear pinned by a pin 45 in a position where the sleeve 44 closes off the valve ports 43. Upon the application of sufficient pressure on the exterior of the housing 41 greater than the pressure in the bore of the housing, the differential pressure acts to shear the pin 45 and move the valve sleeve 44 upwardly. The valve sleeve 44 has a recess 46 which receives a spring biased latching ring 47 in an uppermost position of the sleeve 44 to retain the sleeve 44 in a locked position with the ports 43 opened. Thus, well fluid exterior to the housing 40 can be used to reverse out cement slurry in the string of tubing above the circulation valve.

FIG. 4 through FIG. 8 illustrate the use of the well tool in an inflatable packer. The inflatable packer 99 includes a tubular support member 200 underlying an expandable elastomer packer element 201 which typically is 20 to 40 feet in length. The inflatable packer 99 has valve means 203 which are disposed in a passageway between an opening in the bore 205 of the packer device and the interior space between the support member 200 and the packer element 201. The valve means 203 operates to open in response to sufficient pressure to admit a slow setting cement slurry and shuts off to retain the cement slurry in an inflated packer element. As illustrated, the lower end of the packer device 99 has an annular recess to define an upwardly facing shoulder 95 just above the locating recess 59 (see FIG. 9).

The inflatable packer devices are connected to one another by pipe connections and disposed in a well bore (see FIG. 1). The pipe sections between the packer devices may be pre-perforated or slotted or may be perforated after the packer devices are inflated. While preslotted pipes are a preferred completion, it is possible to perforate through an inflated packer device for production or use other completion techniques.

With the inflatable packer devices in location in a well bore, the well tool of the present invention is lowered on a string of tubing to the lowermost packer device. The detent means 92 are utilized and useful in assurance at the earth's surface that a tool is properly located in a packer device but pipe measurements could be sufficient for accuracy in any number of instances. As shown in FIG. 4, in an initial condition the dog elements 58 are retracted within the well tool, the packing elements 102,104 are unset and the valve ports 130,132,134,136 are isolated so that the valve means in the well tool is closed.

From this initial condition as shown in FIG. 5 a plug 85 is sized to pass through the tubing string and the central actuating member 52 of the well tool to seat in the plug seat 84 and under sufficient well fluid pressure enables the shear pin 76 to shear so that the locking collar 64 moves from a fist position to a second position relative to the lower expander collar 54. In the second position, the locking collar 64 is locked in position by a snap ring 81 in a recess 82 and the dog elements 58 are spring biased outwardly of the well tool.

The pressure on the plug 85 is then further increased to a sufficient value to shear the pin 86 which opens the bypass ports 90 in the lower end of the locking collar 64.

Figure 6:
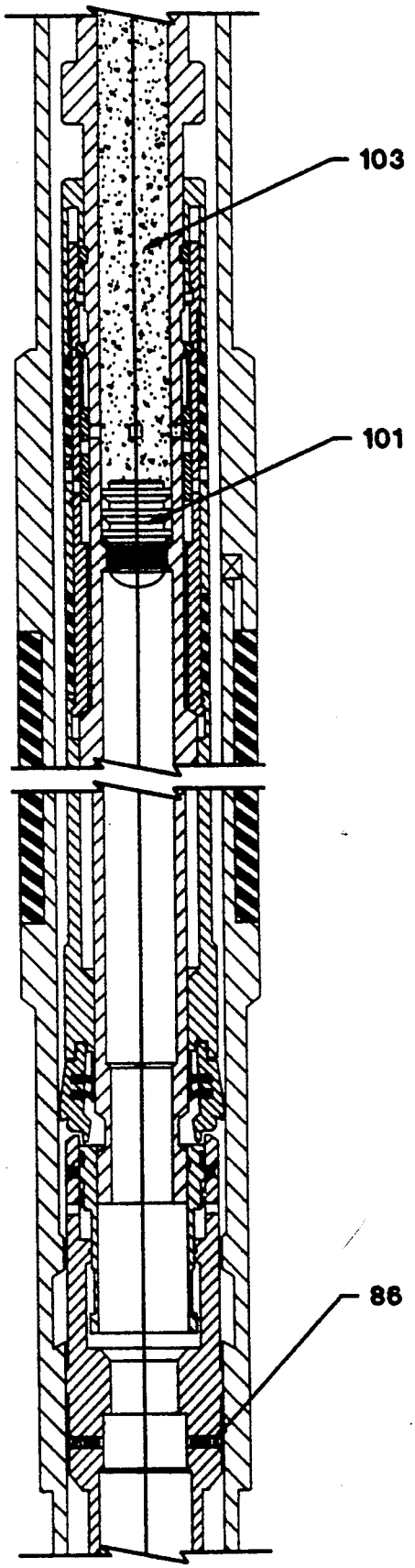
FIG. 6 is a view in longitudinal quarter section of the well tool of FIG. 3A,3B with cement slurry introduced into the well tool.

As shown in FIG. 6, a second plug 101 can be pumped down in front of a column of cement slurry to seat in a bore section 152 (see FIG. 3A) so that the cement is available to actuate the inflatable packer. As illustrated the plug seat 84 is moved from the bore to open the bypass ports 90.

Figure 7:
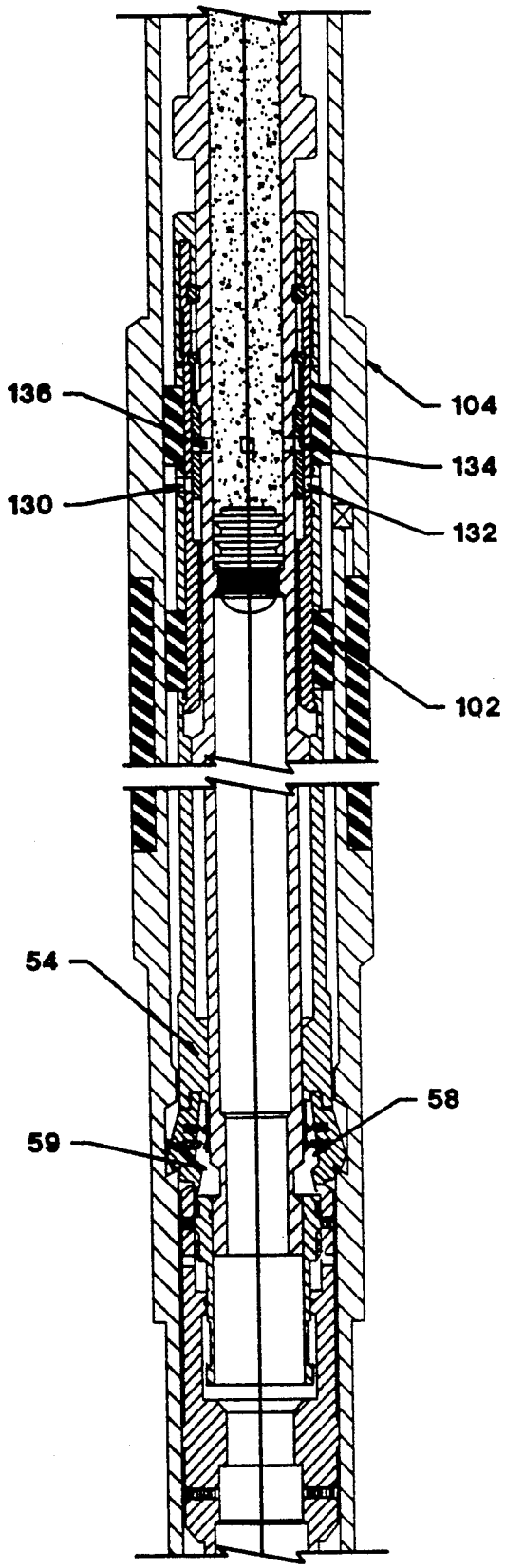
FIG. 7 is a view in longitudinal quarter section of the well tool of FIG. 3A,3B with the dog elements in an anchoring position.

As shown in FIG. 7, a downward stroke of the tubing string engages the dog members 58 with the annular latching groove 59 and provides a stop for the lower expander collar 54 so that the packer elements 102,104 can be expanded and locked into a state of compression before the ports 134,136 are aligned with the ports 130,132. Thus, the pack-off above and below an access port to the inflatable packer device is obtained before the valve of the well tool is opened.

Figure 8:
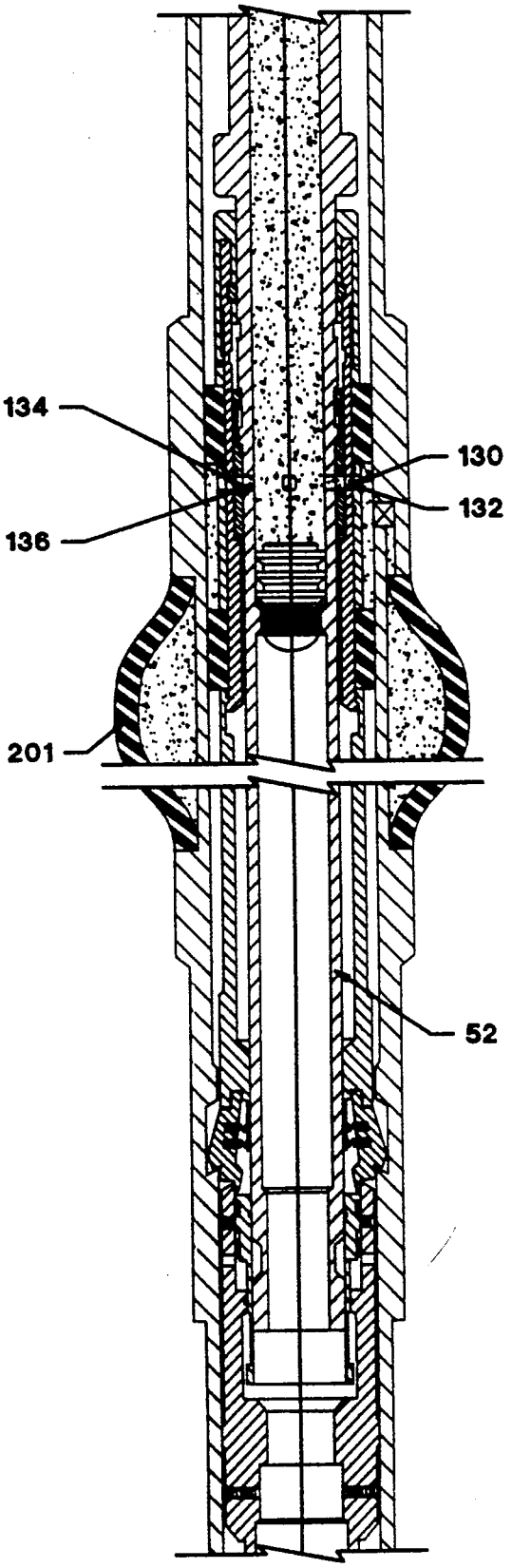
FIG. 8 is a view in longitudinal quarter section of the well tool of FIG. 3A,3B with the well tool valve opened and an inflatable packer element inflated.

As shown in FIG. 8, further downward travel of the central actuating member 52 aligns the ports 134,136 with the ports 130,132 so that the valve in the well tool is open and the cement slurry in the tubing string has access to the packed off space in the inflatable packer so that cement slurry is admitted into the inflatable packer through its access opening and valve means to inflate the packer element 201 with cement slurry.

When the inflatable packer element 201 is filled and the well bore sealed off, the operation is discontinued by discontinuing the pump pressure on the cement slurry and lifting upon the string of tubing. The well tool sequentially operates in a reverse fashion with the valve first closing (FIG. 7) and then the packer elements 102,104 unsetting (FIG. 6) so that the dog elements can be released from the locking groove. Because the locking collar and expander collar are locked in a second and open condition, the tool can be raised while it still contains cement slurry to locate the next above profile When the profile is located, the tool can be lowered to latch the dog elements 58 in a profile, set the packer elements 102,104 and open the valve by aligning the ports 130,132,134,136 to inflate the next above or next selected packer device.

When the final cement slurry injection has been performed, the tool is raised to a blank section of pipe so that pressure on fluid or liquid in the annulus can be used to open the circulation valve 40 and reverse the cement slurry from the tubing string.

While the present invention has been described relative to injecting cement slurry into inflatable packer devices to inflate such devices with cement it should be recognized that the tool provides a straddle packer device with a valve and anchor. While the anchor is shown as actuated by hydraulic pressure in longitudinal motion, the straddle packer and valve operated by longitudinal motion can utilize other types of anchors for other applications. For example, a j-slot operated slip anchor or a hydraulic operated slip anchor could be useful in some instances with the straddle packer and valve for either injected or receiving liquids.

It will be apparent to those skilled in the art that various changes may be made in the invention without departing from the spirit and scope thereof and therefore the invention is not limited by that which is enclosed in the drawings and specifications but only as indicated in the appended claims.

We claim:

1. A locking and transfer system for use in well tools for shifting and locking co-axially arranged tubular members including:

a tubular central actuating member adapted for coupling to a string of tubing for upward and downward movement by manipulation of the string of tubing;

an outer first tubular member disposed on said central actuating member;

a second tubular member disposed on said central actuating member between said central actuating member and said first tubular member;

said outer first tubular member having inner and outer tubular parts defining an annular recess; said inner tubular part being disposed intermediate of said second tubular member and the central actuating member so that a portion of said second tubular member is slidably disposed in said annular recess;

said inner tubular part having circumferentially arranged recesses and detent members in said recesses which are coupled to longitudinally extending spring members for radial movement relative to said inner tubular part;

said central actuating member having a first annular locking recess for locking said detent members between a wall surface of said second tubular member and said first annular locking recess whereby said central actuating member is releasably interconnected to said inner tubular part of said first tubular member in a first longitudinal position of said central actuating member; and said second tubular member having an annular receiving recess longitudinally spaced from said first annular locking recess in said first longitudinal position of said central actuating member whereby movement of said central actuating member to a second longitudinal position relative to said second tubular member conjunctively moves said inner tubular part and said first tubular member until said detent members are adjacent to said annular receiving recess so that said detent members can be shifted from said first annular locking recess to said annular receiving recess and said central actuating member is released from said first tubular member and whereby further movement of said central actuating member relative to said second tubular member locks the detent members between a wall surface of said central actuating member and said annular receiving recess.

2. The system as set forth in claim 1 and further including a third tubular member on said central actuating member and disposed on said central actuating member between said second tubular member and said central actuating member, said third tubular member having locking detent members disposed in another annular recess in said second tubular member for releasably locking said third tubular member to said second tubular member between a wall surface on said central actuating member and said other annular recess on said second tubular member, said central actuating member having another annular recess displaced longitudinally from said first annular locking recess for positioning adjacent to said locking detent members for releasing said locking detent members from the other annular recess in said second tubular member in said second longitudinal position of said central actuating member.

3. A locking and transfer system for use in well tools for shifting and locking co-axially disposed tubular members including:

three tubular members are co-axially arranged as a central actuating member, an outer tubular member and an intermediate tubular member.

a first locking recess on said central actuating member for coupling said central actuating member and said outer tubular member to one another for conjunctive movement from a first longitudinal position to a second longitudinal position of said central actuating member relative to said intermediate tubular member, a second locking recess on said intermediate tubular member for coupling said outer tubular member to said intermediate tubular member at said second longitudinal position and for releasing said first locking means, locking element means carried by said outer tubular member and cooperating with said first locking recess between said first and second longitudinal positions for said conjunctive movement, said locking element means cooperating with said second locking recess between said second longitudinal position and a third longitudinal position for coupling said outer tubular member to said intermediate tubular member and for releasing said central actuating member from said outer tubular member.

4. The locking and transfer system as defined in claim 3 and further including a fourth slidable tubular member co-axially disposed between said intermediate tubular member and said central actuating member, locking detent means on said slidable tubular member, a third locking recess on said intermediate member cooperating with said locking detent means on said slidable tubular member for coupling said slidable tubular member to said intermediate tubular member, a release and actuating recess means on said central actuating member for releasing said locking detent means on said slidable tubular member from said third locking recess in said second longitudinal position and for engaging said locking detent means to move said slidable tubular member conjunctively with said central actuating member between said second and third longitudinal positions.

5. A method of moving and locking relatively movable co-axially disposed tubular members where three tubular members are co-axially arranged as a central actuating member, an outer tubular member and an intermediate tubular member including the steps of:

holding the intermediate tubular member fixed while longitudinally moving the central actuating member in one direction between first, second and third longitudinal positions relative to said intermediate tubular member, releasably locking said outer tubular member to said central actuating member for conjunctive movement between said first and said second longitudinal positions, unlocking said outer tubular member from said central actuating member at said second position and releasably locking said outer tubular member to said intermediate tubular member while said central actuating member moves between said second and third longitudinal positions.

6. The method as set forth in claim 5 wherein said co-axially disposed tubular members includes a fourth tubular member co-axially disposed between said central actuating member and said intermediate tubular member and further including the steps of:

holding said fourth tubular member in a locked condition relative to said intermediate tubular member between said first and second positions, releasing said fourth tubular member from said intermediate tubular member in said second position and conjunctively moving said fourth tubular member with said central actuating member between said second and third longitudinal positions.

7. The method as set forth in claim 5 and including the steps of moving said central actuating member in an opposite direction from said third longitudinal position to said first longitudinal position and conjunctively moving said fourth tubular member and said central actuating member between said third to said second longitudinal positions while maintaining said outer tubular member releasably locked to said intermediate tubular member, at said second longitudinal position, releasing said fourth tubular member from said central actuating member and releasing said outer tubular member from said intermediate tubular member, moving said central actuating member between said second and first longitudinal positions and conjunctively moving said outer tubular member with said central actuating member while locking said fourth tubular member in a fixed position relative to said intermediate tubular member.

8. An anchor system for a well tool for use in a well bore, said anchor system including a central actuating member adapted for coupling to a string of tubing, a first tubular member disposed on said central actuating member for permitting longitudinal movement of the central actuating member relative to said first tubular member between first and second longitudinal positions, said first tubular member having a number of circumferentially arranged, elongated recesses, elongated dog members disposed in said elongated recesses for pivotal movement to extend one end of a dog member between a retracted and an extended condition relative to said first tubular member, spring means for biasing a dog member toward an extended condition, a second tubular member slidably disposed on said first tubular member and located so that an end of said second tubular member overlaps the one end of the dog members in a first position to retain said dog members in a retracted condition in said elongated recess, release means releasably interconnecting said second tubular member to said first tubular member, a tubular valve seat in said second tubular member for receiving a plug element for operating said release means and for moving said second tubular member relative to said first tubular member from said position to a second position to release said one ends of said dog members for movement toward an extended condition.

9. The apparatus as set forth in claim 8 wherein said second tubular member has position locating means thereon for cooperation with a locating position recess in a well bore to locate the anchor system relative to the locating position recess in a well bore.

10. The apparatus as set forth in claim 8 and further including locking means for retaining said second tubular member in said second position.

11. An anchor system for a well tool for use in a well bore, said anchor system including a central actuating member adapted for coupling to a string of tubing, a first tubular member disposed on said central actuating member for permitting longitudinal movement of the central actuating member relative to said first tubular member between first and second longitudinal positions, said first tubular member having a number of circumferentially arranged, elongated recesses, elongated dog members disposed in said elongated recesses for pivotal movement to extend one end of a dog member between a retracted and an extended condition relative to said first tubular member, spring means for biasing a dog member toward an extended condition, a second tubular member slidably disposed on said first tubular member and located so that an end of said second tubular member overlaps the one end of the dog members in a first position to retain said dog members in a retracted condition in said elongated recess, release means releasably interconnecting said second tubular member to said first tubular member, means for operating said release means for moving said second tubular member relative to said first tubular member from said first position to a second position to release said one ends of said dog members for movement toward an extended condition, said dog members in said first position having locking tab portions in engagement with recess means on said control actuating member for interlocking said central actuating member to said dog members, said locking portions being released from said recess means in said extended condition.

12. The apparatus as set forth in claim 11 wherein said dog members in an extended condition also have a portion in engagement with said end of said second tubular member to limit outward travel of a dog member.

* * * * *